US010905935B2

(12) United States Patent
Hazell

(10) Patent No.: US 10,905,935 B2
(45) Date of Patent: Feb. 2, 2021

(54) BREAKAWAY DEVICE FOR MOUTHGUARD

(71) Applicant: Benjamin Morgan Hazell, Lynn, MA (US)

(72) Inventor: Benjamin Morgan Hazell, Lynn, MA (US)

( * ) Notice: Subject to any disclaimer, the term of this patent is extended or adjusted under 35 U.S.C. 154(b) by 308 days.

(21) Appl. No.: 15/830,344

(22) Filed: Dec. 4, 2017

(65) Prior Publication Data

US 2018/0154241 A1 Jun. 7, 2018

Related U.S. Application Data

(60) Provisional application No. 62/429,918, filed on Dec. 5, 2016.

(51) Int. Cl.
*A63B 71/08* (2006.01)
*A63B 71/00* (2006.01)

(52) U.S. Cl.
CPC ..... *A63B 71/085* (2013.01); *A63B 71/0054* (2013.01); *A63B 2071/0072* (2013.01); *A63B 2071/088* (2013.01)

(58) Field of Classification Search
CPC ..... A63B 71/085; A63B 71/0054; A63B 2071/0072; A63B 2071/088; A45F 3/02; A45F 3/14; A45F 2003/002; A45F 2003/006; A45F 2003/007; A45F 2003/142; A45F 2003/146; A44C 5/2076; A44C 5/209; A44C 5/20; A44C 5/185; A44C 5/18; A44C 13/00; A44C 15/00; A44C 15/005
See application file for complete search history.

(56) References Cited

U.S. PATENT DOCUMENTS 2,694,397 A * 11/1954 Herms ..... A61B 1/24 128/861
3,485,242 A * 12/1969 Greenberg ..... A63B 71/085 128/862
4,848,365 A 7/1989 Guarlotti et al.
4,977,905 A * 12/1990 Kittelsen ..... A63B 71/085 128/861

(Continued)

FOREIGN PATENT DOCUMENTS

WO 2007/049048 A1 5/2007

OTHER PUBLICATIONS

"Athletic Mouthguards: Indications, Types, and Benefits", Dentistry Today, Dec. 1, 2005, Retrieved from: http://www.dentistrytoday.com/sports-dentistry/357-athletic-mouthguards-indications-types-and-benefits?tmpl=component&print=1&page= on Sep. 30, 2016.

(Continued)

*Primary Examiner* — Rachael E Bredefeld
*Assistant Examiner* — Camtu T Nguyen
(74) *Attorney, Agent, or Firm* — Arent Fox LLP

(57) ABSTRACT

A breakaway device for a mouthguard is provided, having a lanyard assembly couplable to a mouthguard assembly. The lanyard assembly includes a mouthguard tether couplable to the mouthguard assembly, and a neck tether that can be worn around a user's neck. The lanyard assembly also includes front and rear breakaway connectors, such that when a tensile force is exerted on the mouthguard tether or the neck tether, one or both of the breakaway connectors detaches before the mouthguard tether or neck tether separates.

11 Claims, 9 Drawing Sheets

(56) References Cited

U.S. PATENT DOCUMENTS

| | | | | |
|---|---|---|---|---|
| 5,027,477 | A | 7/1991 | Seron | |
| 5,234,005 | A | 8/1993 | Kittelsen et al. | |
| 5,244,135 | A * | 9/1993 | Nelson | A45F 5/00 224/257 |
| 5,263,857 | A * | 11/1993 | DeWoskin | A61C 7/06 433/5 |
| 5,353,810 | A | 10/1994 | Kittelsen et al. | |
| 5,365,946 | A * | 11/1994 | McMillan | A63B 71/085 128/861 |
| 5,379,928 | A * | 1/1995 | Mikkelsen | A45C 13/30 224/191 |
| 5,732,715 | A * | 3/1998 | Jacobs | A63B 71/085 128/861 |
| 6,073,317 | A * | 6/2000 | Barison | A44B 11/2588 24/115 F |
| 6,539,588 | B1 | 4/2003 | Brosofsky et al. | |
| 6,752,305 | B2 | 6/2004 | Shattuck | |
| 7,353,828 | B1 * | 4/2008 | Hirshberg | A63B 71/085 128/859 |
| 7,708,018 | B1 | 5/2010 | Hirshberg | |
| 8,074,658 | B2 | 12/2011 | Kittelsen et al. | |
| 8,603,393 | B1 * | 12/2013 | DolceAmore | A61L 2/18 422/28 |
| 9,101,185 | B1 * | 8/2015 | Greenberg | A44C 5/20 |
| 2003/0141325 | A1 * | 7/2003 | Balogh, II | A45F 5/00 224/101 |
| 2006/0010657 | A1 * | 1/2006 | Warren | A45F 3/14 24/3.1 |
| 2006/0196900 | A1 * | 9/2006 | Sasick | A45F 5/00 224/183 |
| 2009/0114232 | A1 * | 5/2009 | Landi | A63B 71/085 128/859 |
| 2009/0255095 | A1 | 10/2009 | Gillard et al. | |
| 2012/0012119 | A1 | 1/2012 | Landi et al. | |

OTHER PUBLICATIONS

"Mouthguards", Oral Health Topics, American Dental Association, Nov. 20, 2015.

S-Y Lee, et al., "Effect of the Mandibular Orthopedic Repositioning Appliance (MORA) on Forearm Muscle Activation and Grasping Power during Pinch and Hook Grip", J. Phys. Ther. Sci., (2014), vol. 26 pp. 195-197.

ArtPromos Personalized Lanyard, Retrieved from http://www.artpromos.com/product/personalized-lanyard-3-4-34-breakaway-lanyard/1175/ on Feb. 3, 2016.

Nike Intake Youth Mouthguard, Retrieved from: http://www.sportsunlimitedinc.com/nike-intake-youth-mouthguard.html on Feb. 3, 2016.

* cited by examiner

BREAKAWAY DEVICE FOR MOUTHGUARD

CROSS REFERENCE TO RELATED APPLICATIONS

This application claims priority under 35 U.S.C. § 119(e) of U.S. Provisional Application No. 62/429,918, filed on Dec. 5, 2016, entitled "Breakaway Device for Mouthguard," the disclosure of which is hereby incorporated by reference.

STATEMENT REGARDING FEDERALLY SPONSORED RESEARCH OR DEVELOPMENT

N/A

BACKGROUND

Every year, many dental and head injuries are incurred during sports activities. For example, injuries to the jaw can result in avulsed teeth and even in concussions. Injuries can occur from blows to the mouth or jaw area or from falls during which the mouth or jaw area strikes the ground or another object. In many cases, such injuries could be prevented or lessened if the player were to wear a mouthguard.

Several types of mouthguards are available, ranging from stock mouthguards to boil-and-bite mouthguards and custom mouthguards. In all cases, it is important for the user to actually use the mouthguard. Some mouthguards are attached by a tether to a face guard or helmet.

SUMMARY

A breakaway device for a mouthguard is provided that can increase the likelihood of use and safety of use of a mouthguard by all types of athletes. The breakaway device employs a lanyard assembly with front and rear breakaway connectors for attachment to a mouthguard to provide additional safety and convenience for the user. The lanyard assembly includes a mouthguard tether that connects to the mouthguard and a neck tether that can be worn around a user's neck. A front breakaway connector is provided between the mouthguard tether and the neck tether. A rear breakaway connector is provided at a portion of the neck tether that falls at the back of the user's neck.

With this device, if the mouthguard tether is pulled from the front, the front breakaway connector can detach, preventing the mouthguard from being pulled out of the user's mouth. If the neck tether is pulled from the front or back, either the front breakaway connector or the rear breakaway connector, or both, can detach, again preventing the mouthguard from being pulled out of the user's mouth. In this manner, injury from inadvertently and undesirably pulling the mouthguard out of the user's mouth can be avoided. While the device can be used with any sport or activity, the device is particularly suitable for use in sports such as flag football and women's lacrosse that do not employ a face guard or helmet to which a traditional mouthguard can be attached. The user can retain the mouthguard on the lanyard assembly around the neck so that the mouthguard does not get lost or dropped on the ground or chewed on, rendering it useless. The user is more likely to continue to use a mouthguard that does not need replacement so frequently. When a new mouthguard is needed or desired, it can be readily attached to the lanyard assembly when needed or desired. The breakaway connectors can also be reconnectable so that the lanyard assembly can be reused.

DESCRIPTION OF THE DRAWINGS

The invention will be more fully understood from the following detailed description taken in conjunction with the accompanying drawings in which.

DETAILED DESCRIPTION

Figure 1:
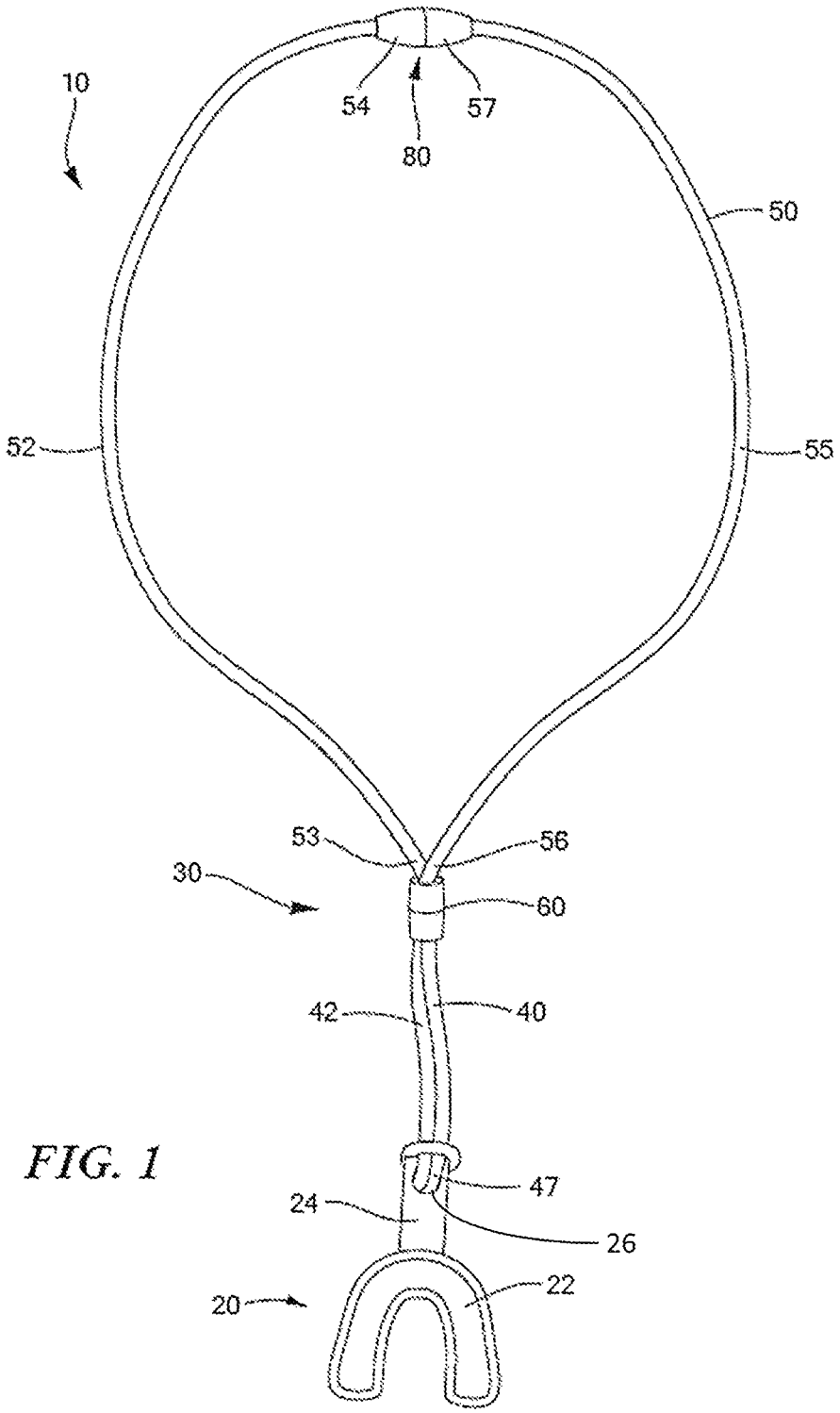
FIG. 1 is an isometric view of an embodiment of a mouthguard and breakaway lanyard device according to the invention.

One embodiment of a breakaway device 10 is illustrated in FIGS. 1-7B. Referring to FIG. 1, a mouthguard assembly 20 has a mouthguard 22 configured to be placed within a mouth of a user 5. A mouthguard tab 24 is attached to a front of the mouthguard to extend externally from the user's mouth when the mouthguard is placed in the mouth. The breakaway device includes a lanyard assembly 30 having a mouthguard tether 40, a neck tether 50, a front breakaway connector 60, and a rear breakaway connector 80. The mouthguard tether 40 is coupled to the mouthguard tab 24 and fixed to the front breakaway connector 60, and the neck tether 50 is fixed to the front breakaway connector 60 and to the rear breakaway connector 80.

Figure 2A:
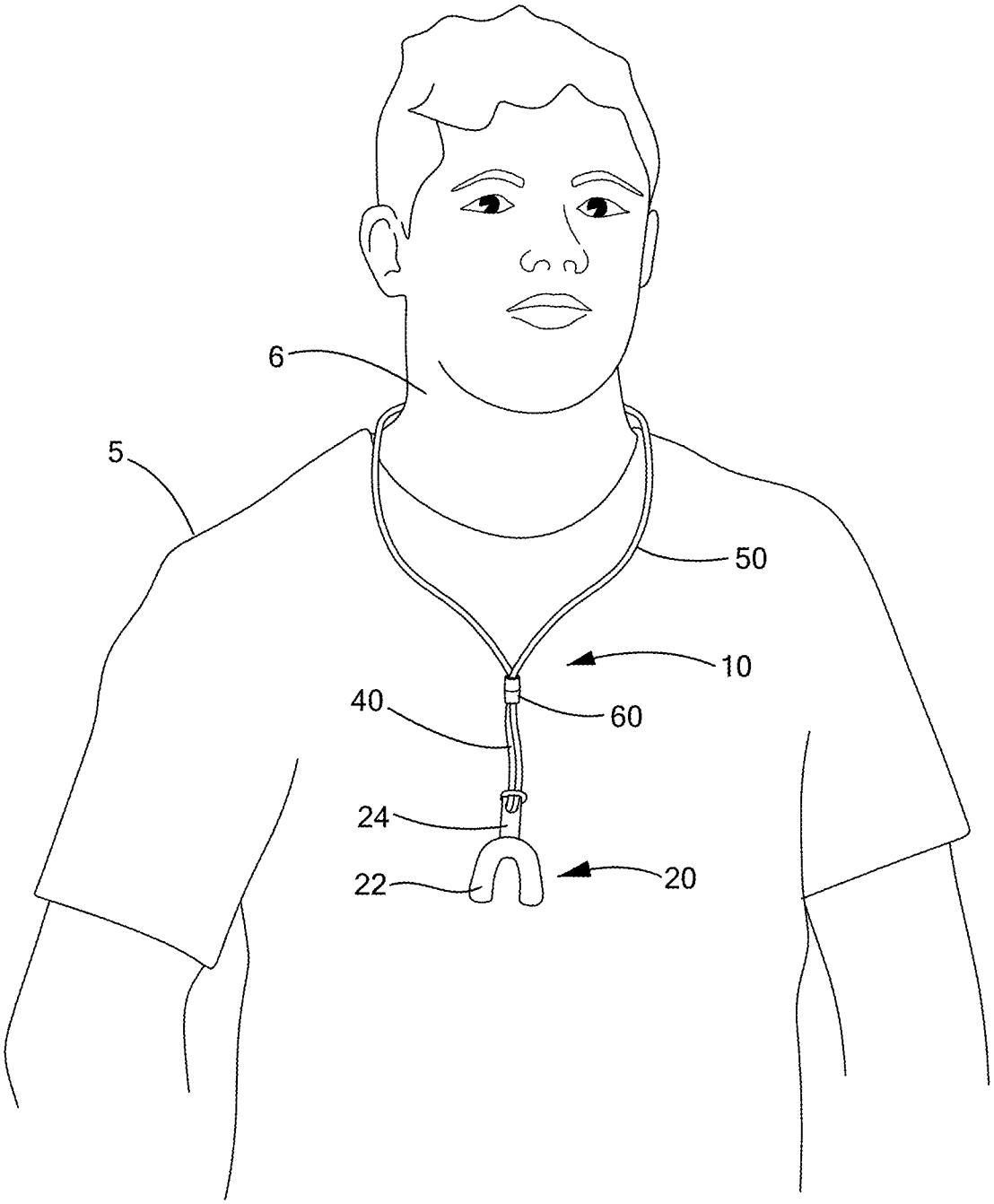
FIG. 2A is a front view of a user wearing the device of FIG. 1.
Figure 2B:
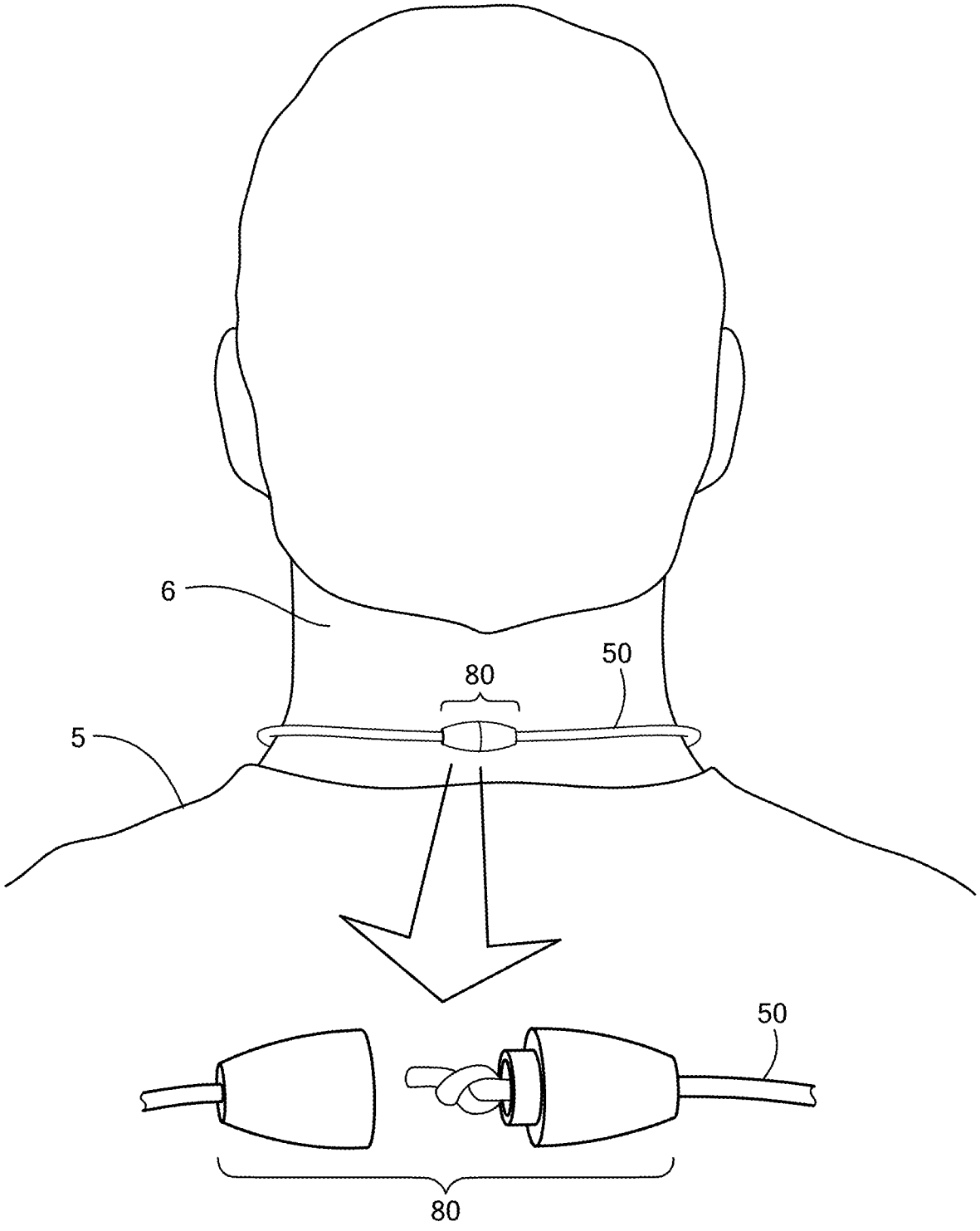
FIG. 2B is a rear view of the user wearing the device of FIG. 1 with an enlarged portion illustrating a rear breakaway connector in a detached condition.
Figure 3A:
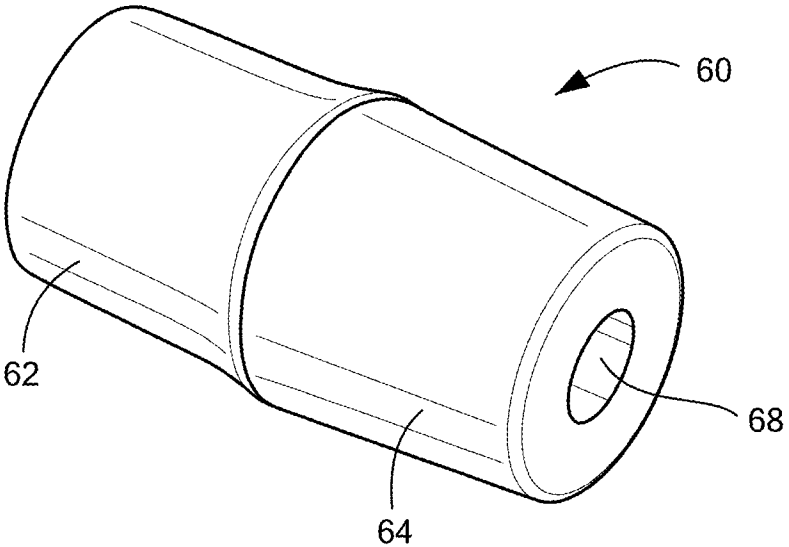
FIG. 3A is an isometric view of a front breakaway connector of the device of FIG. 1.
Figure 3B:
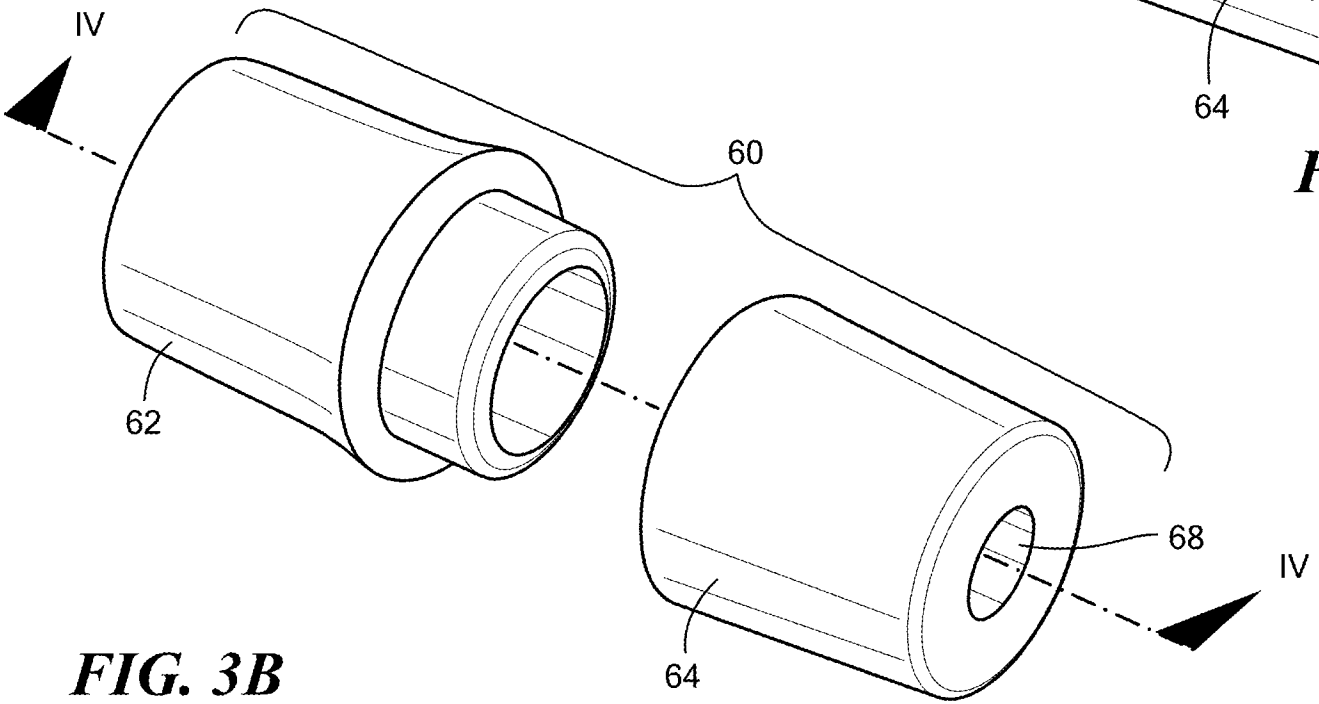
FIG. 3B is an exploded view of the front breakaway connector of FIG. 3A.
Figure 4:
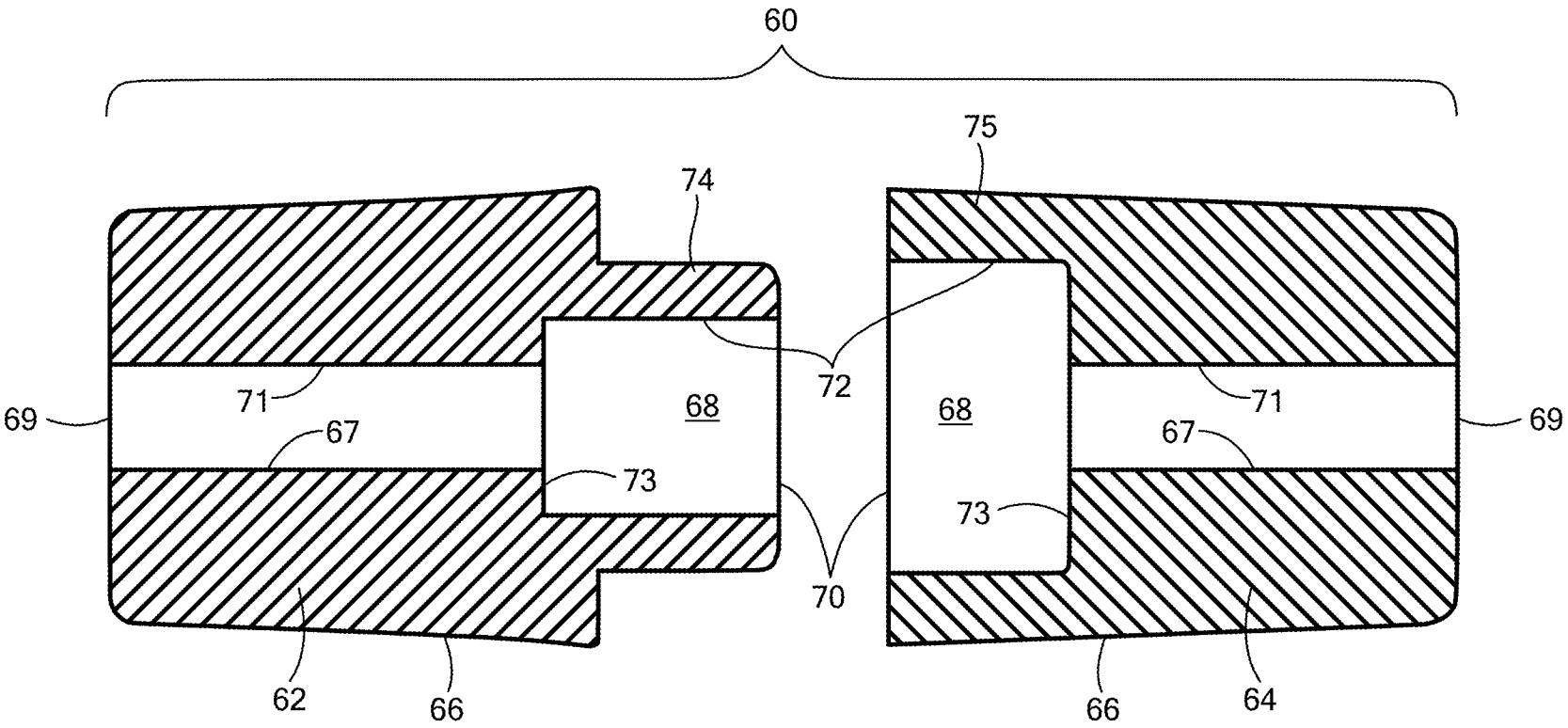
FIG. 4 is a cross sectional view along line IV-IV of FIG. 3B.
Figure 5A:
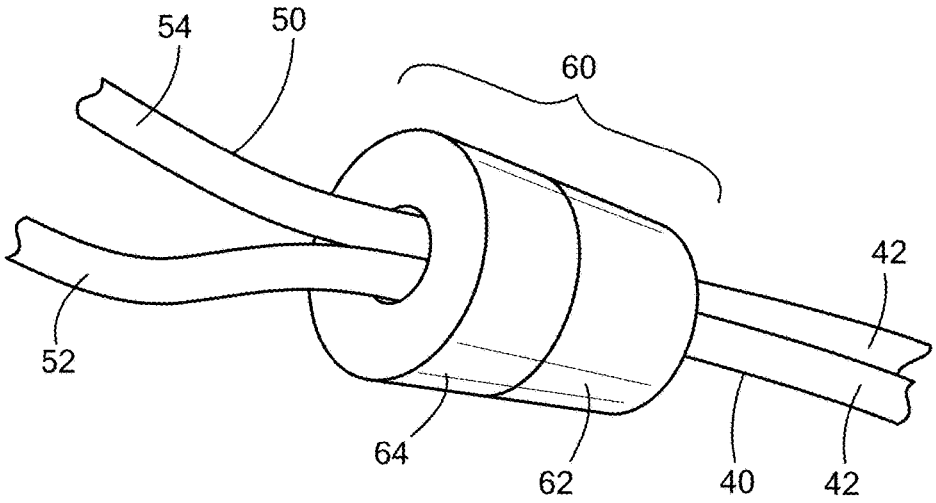
FIG. 5A is a further isometric view of the front breakaway connector of FIG. 3A illustrating a mouthguard tether and a neck tether.
Figure 5B:
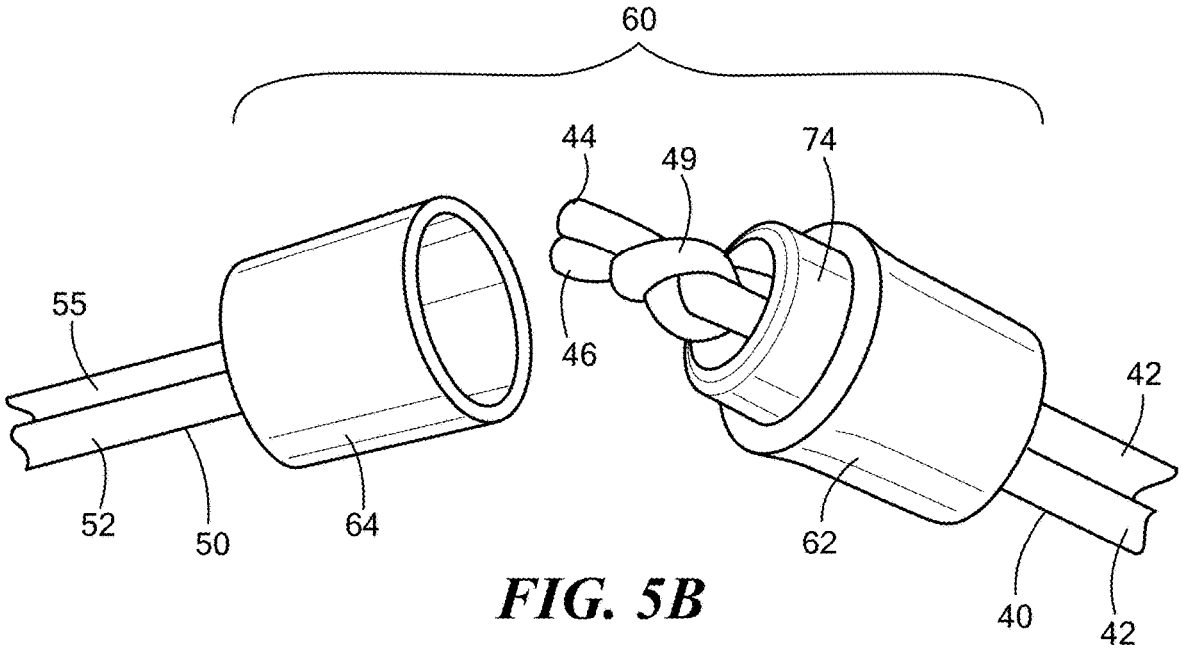
FIG. 5B is an exploded view of the front breakaway connector of FIG. 5A.

The neck tether 50 is sized to be worn around the user's neck 6, with the rear breakaway connector 80 at the back of the user's neck. See FIGS. 2A and 2B. The mouthguard assembly 20 can hang down on the user's chest when not needed in the user's mouth, as shown in FIG. 2A. Thus, the user is less likely to lose the mouthguard or drop it on the ground. Additionally, the user is more likely to use a mouthguard.

The breakaway connectors 60, 80 are configured to detach into two connector members (described further below) when a sufficient tensile force is exerted thereon. More particularly, when a tensile force is exerted on the mouthguard tether 40 or the neck tether 50 while the mouthguard is in the user's mouth, the front breakaway connector 60 is configured to detach before the mouthguard tether 40 is able to separate from the front breakaway connector 60 or from the mouthguard assembly 20, and before the neck tether 50 is able to separate from the front breakaway connector member 60. Similarly, when a tensile force is exerted on the neck tether 50, the rear breakaway connector 80 is configured to detach before the neck tether 50 is able to separate from the rear breakaway connector 80. See FIG. 2B. Also, the tethers 40, 50 can be selected to have a tensile strength greater than the force required to detach the breakaway connectors 60, 80, such that the tethers 40, 50 are not likely to break before the breakaway connectors 60, 80 detach. In this manner, a tensile force on either the mouthguard tether 40 or the neck tether 50 can be prevented from exerting a force on a mouthguard assembly 20 while in the user's mouth, minimizing or eliminating a risk of injury to the user's mouth from such a force. In some embodiments, the breakaway connectors 60, 80 can be configured to detach at a tensile force of at least 5 lb., at least 6 lb., at least 7 lb., at least 8 lb., at least 9 lb., or at least 10 lb. In other embodiments, the breakaway connectors can be configured to detach at a lesser or a greater tensile force, depending on the application. The breakaway connectors can also be configured to be reattached, such that the lanyard assembly can be reused.

Figure 6A:
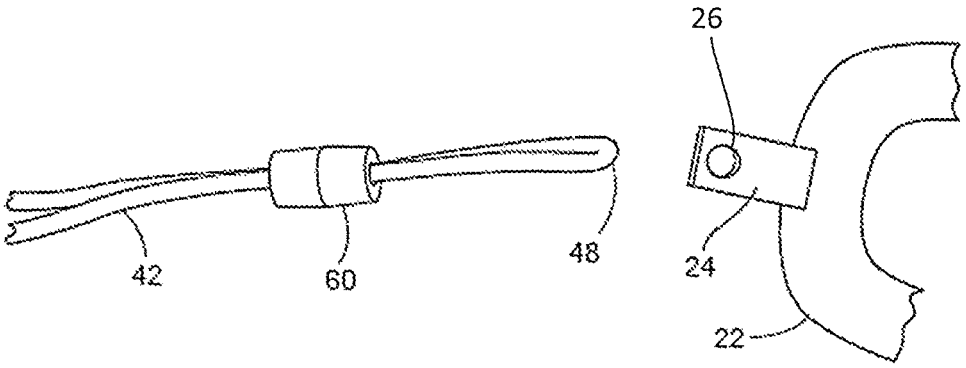
FIG. 6A illustrates a first step in attaching a neck tether to a mouthguard.
Figure 6B:
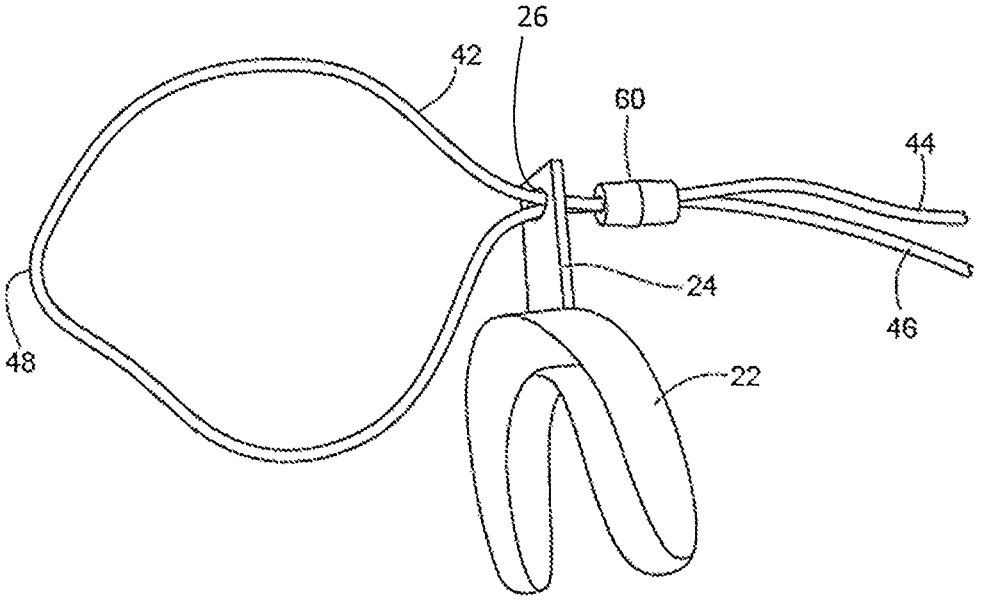
FIG. 6B illustrates a second step in attaching a neck tether to a mouthguard.
Figure 6C:
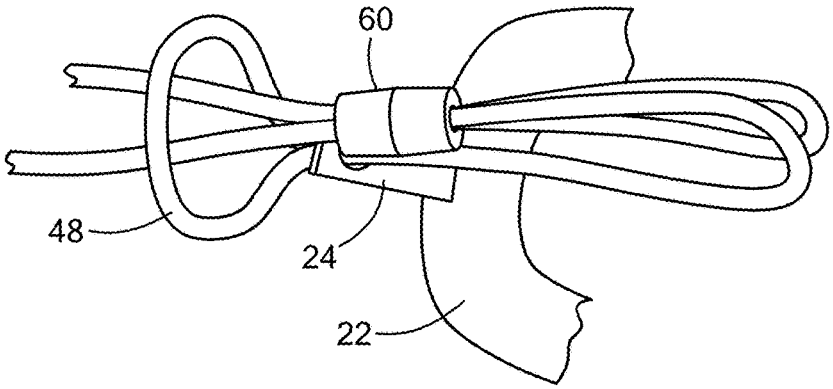
FIG. 6C illustrates a third step in attaching a neck tether to a mouthguard.
Figure 6D:
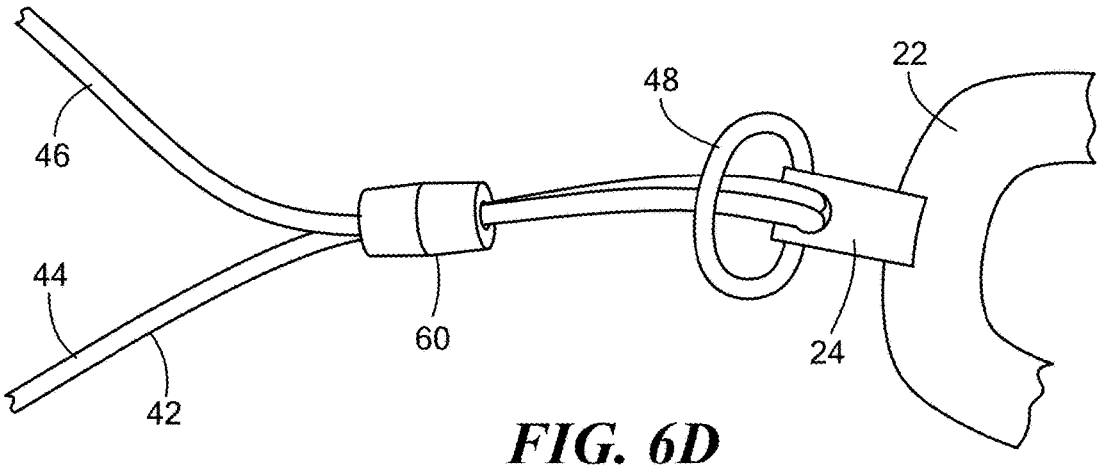
FIG. 6D illustrates a fourth step in attaching a neck tether to a mouthguard.
Figure 6E:
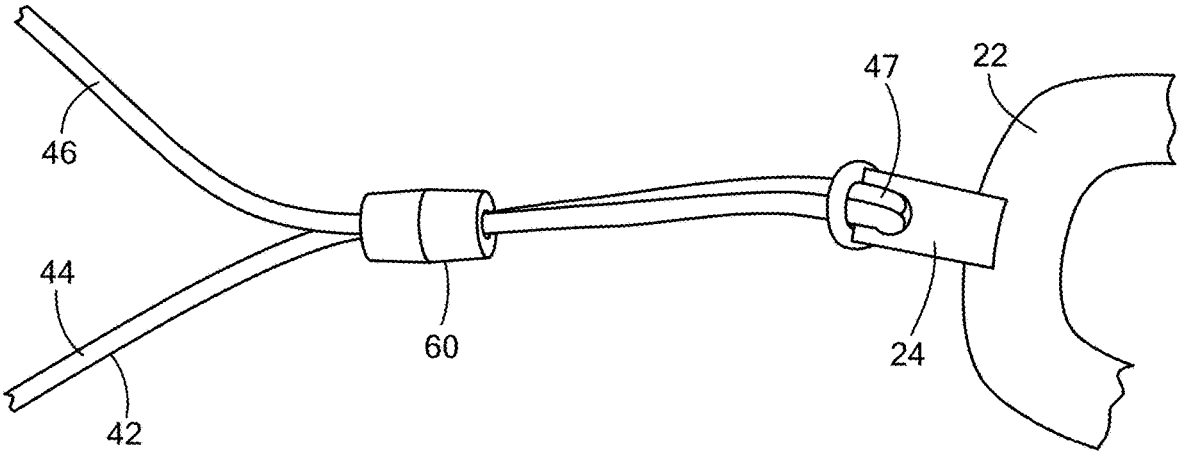
FIG. 6E illustrates a fifth step in attaching a neck tether to a mouthguard.

The mouthguard tether 40 is formed from a length 42 of cord or webbing extending from a first end 44 to a second end 46. The mouthguard tether is coupled at or near a midpoint to the mouthguard tab. In some embodiments, an aperture 26 is formed in the mouthguard tab 24, and the mouthguard tether is coupled to the mouthguard tab with a hitch knot 47 through the aperture. A hitch knot is a knot that can join the tether to an object. In some embodiments, a hitch knot is formed with a bight 48 at or near the midpoint of the length 42 of the mouthguard cord (FIG. 6A). The bight 48 is inserted through the aperture 26 in the tab 24 (FIG. 6B). The first and second ends 44, 46 of the mouthguard cord are then passed through the bight 48 (FIGS. 6C, 6D) and pulled taut (FIG. 6E). In some embodiments, the hitch knot can be a cow hitch, also sometimes termed a lark's head knot. In this manner, a new mouthguard can be readily coupled to the lanyard assembly whenever needed or desired. It will be appreciated that the mouthguard tether 40 can be coupled to the mouthguard while connected to the rest of the lanyard assembly 30, or while disconnected from the rest of the lanyard assembly 30.

The neck tether 50 includes first and second neck tether members 52, 55. Each of the first and second neck tether members is formed from a length of cord or webbing extending from a first end 53, 56 to a second end 54, 57.

The front breakaway connector 60 includes a first front connector member 62 and a second front connector member 64 detachably connectable together. In some embodiments, the first and second front connector members are detachably connectable together with a friction fit. The rear breakaway connector 80 similarly includes a first rear connector member 82 and a second rear connector member 84 detachably connectable together. In some embodiments, the first and second rear connector members are detachably connectable together with a friction fit. A friction fit can also allow the connector members to be reconnected after detaching.

The first end 44 and the second end 46 of the mouthguard tether 40 are fixed to the first front breakaway connector member 62, and the first ends 53, 56 of each of the first and second neck tether members 52, 55 are fixed to the second front connector member 64. The second end 54 of the first neck tether member 52 is fixed to the first rear connector member 82, and the second end 57 of the second neck tether member 55 is fixed to the second rear connector member 84.

Referring to FIGS. 3A to 5B, in some embodiments, each of the first front connector member 62 and second front connector member 64 can have an exterior surface 66 and an interior surface 67. The interior surface can define a passage 68 from an outer open end 69 to an inner open end 70. The passage can include a narrow passage section 71 having a first diameter and a wide passage section 72 having a second diameter greater than the first diameter. An interior shelf 73 can extend radially between the narrow passage section and the wide passage section. The narrow passage section extends from the outer open end to the interior shelf, and the wide passage section extends from the interior shelf to the inner open end.

The first end 44 and the second end 46 of the mouthguard tether 40 are fixed to the first front connector member 62. In some embodiments, portions of the mouthguard tether adjacent the first end and the second end can extend through the narrow passage section 71 of the first connector member 62. A stopper knot 49 can be tied at the first end 44 and the second end 46 of the mouthguard tether 40 to prevent the first and second ends of the tether from slipping back through the passage 68 and out of the first front connector member. The stopper knot 49 remains in the wide passage section 72 and abuts against the interior shelf 73 when a tensile force is exerted on the mouthguard tether directed away from the first front connector member, preventing the mouthguard tether 40 from pulling out of the first front connector member 62.

The first ends 53, 55 of each of the neck tether members 52, 55 are fixed to the second front connector member 64. In some embodiments, portions of the neck tether members adjacent the first ends can extend through the narrow passage section 71 of the second connector member. A stopper knot (as described in conjunction with the mouthguard tether) can be tied at the first ends of the neck tether members to prevent the first ends of the neck tether members from slipping back through the passage and out of the second front connector member. The stopper knot remains in the wide passage section and abuts against the interior shelf when a tensile force is exerted on the neck tether members directed away from the second front connector member, preventing the neck tether members from pulling out of the second front connector member.

More particularly, when a tensile force is exerted on the mouthguard tether 40 or the neck tether members 52, 55, the first and second front connector members 62, 64 detach before the mouthguard tether 40 separates from the first front connector member 62 or the mouthguard assembly 20, or the neck tether members 52, 55 separate from the second front connector member 64.

In some embodiments, the friction fit of the front breakaway connector 60 can include an annular extension 74 of one of the first and second front connector members recessed radially inwardly from an exterior surface 66. An annular extension 75 can be provided in the other of the first and second front connector members having an inner diameter sized to frictionally engage an outer diameter of the annular extension 74 of the one front connector member. See FIG. 4.

Figure 7A:
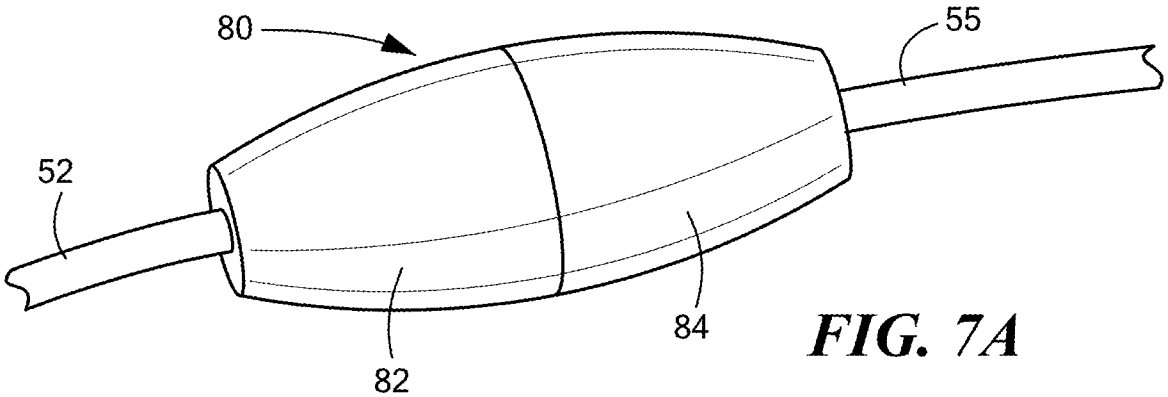
FIG. 7A is an isometric view of a rear breakaway connector of the device of FIG. 1.
Figure 7B:
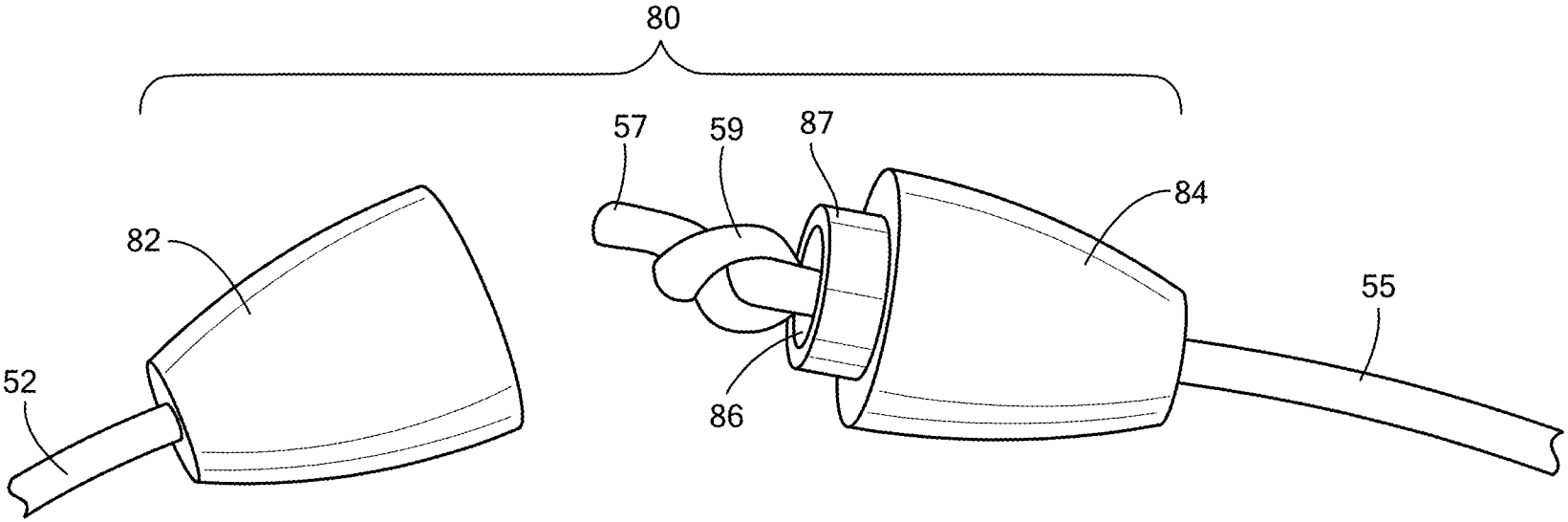
FIG. 7B is an exploded view of the rear breakaway connector of FIG. 7A.

Referring to FIGS. 7A and 7B, in some embodiments, each of the first and second rear connector members 82, 84 can have an exterior surface and an interior surface. The interior surface can define a passage 86 from an outer open end to an inner open end. The passage can include a narrow passage section having a first diameter and a wide passage section having a second diameter greater than the first diameter (as described in conjunction with the front breakaway connector). An interior shelf (as described in conjunction with the front breakaway connector) can extend radially between the narrow passage section and the wide passage section. The narrow passage section extends from the outer open end to the interior shelf, and the wide passage section extends from the interior shelf to the inner open end.

The second end 54 of the first neck tether member 52 is fixed to the first rear connector member 82. In some embodiments, a portion of the first neck tether member adjacent the second end can extend through the narrow passage section of the first rear connector member. A stopper knot can be tied at the second end of the first neck tether member to prevent the second end of the neck tether member from slipping back through the passage and out of the first rear connector member. The stopper knot abuts against the interior shelf when a tensile force is exerted on the neck tether directed away from the first rear connector member, preventing the neck tether from pulling out of the first rear connector member.

The second end 57 of the second neck tether member 55 is fixed to the second rear connector member 84. In some embodiments, a portion of the second neck tether member adjacent the second end can extend through the narrow passage section of the second rear connector member. A stopper knot 59 can be tied at the second end 57 of the second neck tether member 55 to prevent the second end of the neck tether member from slipping back through the passage and out of the second rear connector member 84. See FIG. 7B. The stopper knot abuts against the interior shelf when a tensile force is exerted on the neck tether 50 directed away from the second rear connector member 84, preventing the neck tether from pulling out of the second rear connector member.

More particularly, when a tensile force is exerted on the neck tether members 52, 55, the first and second rear connector members 82, 84 detach before the neck tether members separate from the first and second rear connector members.

In some embodiments, the friction fit of the rear breakaway connector 80 can include an annular extension 87 of the first rear connector member recessed radially inwardly from an exterior surface of the first rear connector member. See FIG. 7B. An annular extension can be provided in the second rear connector member having an inner diameter sized to frictionally engage the outer diameter of the annular extension of the first rear connector member.

In some embodiments, an exterior surface of the front breakaway connector 60 can have a rounded cross section. Similarly, in some embodiments, an exterior surface of the rear breakaway connector 80 can have a rounded cross section. A rounded cross section provides that no sharp edges or corners are present to press against the wearer or to catch against clothing or another object in a manner that would interfere with detachment of the two detachable members of each connector.

In some embodiments, the stopper knot in the ends of the mouthguard tether 40 and the neck tether 50 can be a bend knot. In some embodiments, the bend knot can be a double overhand stopper knot. In some embodiments, the stopper knot can include a separate knot in each of the first end and the second end of the mouthguard tether and/or the first ends of the neck tether. In some embodiments, the stopper knot can join together both the first and second ends of the mouthguard tether and/or both first ends of the neck tether. It will be appreciated that other types of knots can be used. In other embodiments, the ends of the mouthguard tether and the neck tether can be fixed to the front and rear breakaway connectors in other ways, such as with a clamp mechanism or with an adhesive.

In some embodiments, the tethers can be formed from twisted or wound cords or woven webbing. The tethers can be made of any suitable material, such as, without limitation, a polymeric material, such as polyester or nylon; natural fibers, such as cotton; or combinations thereof. The tethers can be selected to have a tensile strength greater than the tensile force needed to detach the breakaway connectors. In some embodiments, the tensile strength can range from about 275 psi to about 325 psi. It will be appreciated that tethers with a greater or lesser tensile strength can be provided.

In some embodiments the lengths of the mouthguard tether and the neck tether can be selected so that the mouthguard falls at approximately the bottom of the sternum when the mouthguard is not held in the user's mouth. The tether lengths can be selected for different sizes, such as for children and adults. In some embodiments, the full length of the neck tether 50 can range from about 24 inches to about 28 inches, or similarly, each of the first and second neck tethers 52, 55 can range from about 12 inches to about 14 inches from their respective first ends 53, 56, to their respective second ends 54, 57. In some embodiments, the length of the mouthguard tether 40 can be about 8 inches in total, from the first end 44 to the second end 46. Other lengths can be provided if desired.

The connectors can be made of any suitable material. The material can be, without limitation, polymeric, elastomeric, thermoplastic, thermoset, or a combination of these materials. Examples include, without limitation, thermoplastic polymers such as nylon, polyethylene, polypropylene, polystyrene, polyvinyl chloride, polyurethane, polyacetal, and acrylonitrile-butadiene-styrene. The material(s) can be selected to achieve desired friction fit characteristics.

The front breakaway connector and the rear breakaway connector can be made by any suitable manufacturing process. In some embodiments, the connectors can be manufactured by machining, injection molding, overmolding, casting, or by one of several additive or rapid manufacturing methods, such as stereolithography, fused deposition, or selective sintering.

The breakaway device can be used for many types of sports and athletic activities, such as, without limitation, soccer, football, basketball, field hockey, lacrosse, squash, racquetball, boxing, ice hockey, ice skating, skateboarding, skiing, volleyball, cycling, mountain biking, gymnastics, and weight lifting. The device is useful for sports such as flag football and women's lacrosse that require use of a mouthguard but do not use helmets or face masks to which the mouthguard can be attached. The device can be used in both organized and unorganized sports and by athletes of all skill levels. The device can be used in both contact and non-contact sports. The device can be used with a mandibular orthopedic repositioning appliance (MORA) to assist with increasing muscle activity and grasping power. Lee et al., "Effect of the Mandibular Orthopedic Repositioning Appliance (MORA) on Forearm Muscle Activation and Grasping Power during Pinch and Hook Grip," J. Phys. Ther. Sci., 26(2), pp. 195-197 (2014).

The device can be used by both adults and children. The device is convenient to use and can increase the likelihood that an athlete uses a mouthguard, thereby achieving the benefits of the mouthguard. For example, use of a mouthguard can prevent or minimize dental injuries to teeth, jaws and oral tissues such as the lips, tongue and inner cheeks, and head injuries that can lead to concussions.

Use of the device minimizes the likelihood that a mouthguard will be dropped on the ground, where it can get dirty and possibly gather germs that can cause disease. This is particularly beneficial in sports that require the use of a mouthguard, which could result in a child placing a dirty, contaminated mouthguard back in the mouth. The device can provide reassurance to parents and coaches that children are better protected, because the device is easy to use and minimizes the risk of loss or dropping of the mouthguard.

The device can be used with any type of mouthguard having an extending tab for attachment, from stock mouthguards to boil-and-bite mouthguards, custom mouthguards, and mandibular orthopedic repositioning appliances (MORAs). Because use of the device minimizes the likelihood of losing a mouthguard, the device can encourage athletes to use a properly fitted custom mouthguard, which although more costly, can provide a greater level of protection than stock or boil-and-bite mouthguards.

Further aspects of the invention are as follows:

1. A breakaway device for a mouthguard, comprising:
   a lanyard assembly comprising:
   a mouthguard tether extending from a first end to a second end, a midsection of the mouthguard tether couplable to a mouthguard, and
   a neck tether comprising first and second neck tether members, each of the first and second neck tether members extending from a first end to a second end;
   a front breakaway connector comprising first and second front connector members detachably connectable together; and
   a rear breakaway connector comprising first and second rear connector members detachably connectable together;
   wherein:
   the mouthguard tether is fixed to the front breakaway connector, and the neck tether is fixed to the front breakaway connector and to the rear breakaway connector;
   when a tensile force is exerted on the mouthguard tether or the neck tether, the first and second front connector members detach before the mouthguard tether separates from the front breakaway connector, and before the neck tether separates from the front breakaway connector member; and
   when a tensile force is exerted on the neck tether, the first and second rear connector members detach before the neck tether separates from the rear breakaway connector.
2. The device of embodiment 1, wherein the first end and the second end of the mouthguard tether are fixed to the first front breakaway connector member, and the first ends of each of the first and second neck tether members are fixed to the second front connector member.
3. The device of any of embodiments 1-2, wherein the second end of the first neck tether member is fixed to the first rear connector member, and the second end of the second neck tether member is fixed to the second rear connector member.
4. The device of any of embodiments 1-3, wherein each of the first and second front connector members comprises an exterior surface and an interior surface, the interior surface defining a passage from an outer open end to an inner open end, the passage comprising a narrow passage section having a first diameter and a wide passage section having a second diameter greater than the first diameter, and an interior shelf extending radially between the narrow passage section and the wide passage section, the narrow passage section extending from the outer open end to the interior shelf, and the wide passage section extending from the interior shelf to the inner open end.
5. The device of embodiment 4, wherein:
   the first end and the second end of the mouthguard tether are fixed to the first front connector member, with portions of the mouthguard tether adjacent the first end and the second end extending through the narrow passage section of the first connector member, and a stopper knot tied at the first end and the second end of the mouthguard tether is disposed in the wide passage section, the stopper knot abutting against the interior shelf when a tensile force is exerted on the mouthguard tether directed away from the first connector member;
   the first ends of each of the neck tether members are fixed to the second front connector member, with portions of the neck tether members adjacent the first ends extending through the narrow passage section of the second connector member, and a stopper knot tied at the first ends the neck tether members is disposed in the wide passage section, the knot abutting against the interior shelf when a tensile force is exerted on the neck tether members directed away from the second connector member; and
   when a tensile force is exerted on the mouthguard tether or the neck tether members, the first and second front connector members detach before the mouthguard tether separates from the first front connector member, or the neck tether members separate from the second front connector member.
6. The device of any of embodiments 1-5, wherein the first and second front connector members are detachably connectable together with a friction fit.
7. The device of embodiment 6, wherein the friction fit of the front breakaway connector comprises:
   an annular extension of one of the first and second front connector members recessed radially inwardly from an exterior surface, and having an outer diameter; and
   an annular extension of the other of the first and second front connector members having an inner diameter sized to frictionally engage the outer diameter of the annular extension of the one front connector member.
8. The device of any of embodiments 1-7, wherein each of the first and second rear connector members comprises an exterior surface and an interior surface, the interior surface defining a passage from an outer open end to an inner open end, the passage comprising a narrow passage section having a first diameter and a wide passage section having a second diameter greater than the first diameter, and an interior shelf extending radially between the narrow passage section and the wide passage section, the narrow passage section extending from the outer open end to the interior shelf, and the wide passage section extending from the interior shelf to the inner open end.
9. The device of embodiment 8, wherein:
   the second end the first neck tether member is fixed to the first rear connector member, with a portion of the first neck tether member adjacent the second end extending through the narrow passage section of the first rear connector member, and a knot tied at the second end of the first neck tether member is disposed in the wide passage section, the knot abutting against the interior shelf when a tensile force is exerted on the neck tether directed away from the first rear connector member;
   the second end of the second neck tether member is fixed to the second rear connector member, with a portion of the second neck tether member adjacent the second end extending through the narrow passage section of the second rear connector member, and a knot tied at the second end of the second neck tether member is disposed in the wide passage section, the knot abutting against the interior shelf when a tensile force is exerted on the neck tether directed away from the second rear connector member; and when a tensile force is exerted on the neck tether members, the first and second rear connector members detach before the neck tether members separate from the first and second rear connector members.

10. The device of any of embodiments 1-9, wherein the first and second rear connector members are detachably connectable together with a friction fit.

11. The device of embodiment 10, wherein the friction fit of the rear breakaway connector comprises:

an annular extension of the first rear connector member recessed radially inwardly from an exterior surface of the first rear connector member, and having an outer diameter, and an annular extension of the second rear connector member having an inner diameter sized to frictionally engage the outer diameter of the annular extension of the first rear connector member.

12. The device of any of embodiments 1-11, wherein one or both of the front breakaway connector and the rear breakaway connector is configured to be reconnectable after detachment.

13. The device of any of embodiments 1-12, wherein an exterior surface of the front breakaway connector has a rounded cross section.

14. The device of any of embodiments 1-13, wherein an exterior surface of the rear breakaway connector has a rounded cross section.

15. The device of any of embodiments 1-14, further comprising a mouthguard assembly comprising a mouthguard configured to be placed within a user's mouth, and a mouthguard tab attached to a front of the mouthguard to extend externally from the user's mouth, and wherein the midsection of the mouthguard tether is couplable to the mouthguard tab.

16. The device of embodiment 15, wherein an aperture is formed in the mouthguard tab, and the mouthguard tether is couplable to the mouthguard tab with a hitch knot through the aperture.

17. The device of any of embodiments 15-16, wherein an aperture is formed in the mouthguard tab, and the mouthguard tether is couplable to the mouthguard tab with a bight at a midsection of the tether inserted through the aperture, and the first and second ends are passed through the bight and pulled taut.

18. The device of any of embodiments 1-17, wherein the mouthguard tether is a twisted or wound cord or woven webbing.

19. The device of any of embodiments 1-18, wherein the neck tether members are twisted or wound cords or woven webbing.

20. The device of any of embodiments 1-19, wherein the neck tether of the lanyard assembly is configured to be worn around a neck of a user with the rear breakaway connector located at a back of the user's neck.

As used herein, "consisting essentially of" allows the inclusion of materials or steps that do not materially affect the basic and novel characteristics of the claim. Any recitation herein of the term "comprising," particularly in a description of components of a composition or in a description of elements of a device, can be exchanged with "consisting essentially of" or "consisting of."

It will be appreciated that the various features of the embodiments described herein can be combined in a variety of ways. For example, a feature described in conjunction with one embodiment may be included in another embodiment even if not explicitly described in conjunction with that embodiment.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

What is claimed is:

1. A breakaway device for a sports protective mouthguard assembly having a mouthguard and a tab attached thereto, the device comprising:

a lanyard assembly comprising:

a mouthguard tether extending from a first end to a second end, the mouthguard tether being couplable to the sports protective mouthguard assembly via a hitch knot extending through an aperture in the mouthguard tab, and a neck tether comprising first and second neck tether members, each of the first and second neck tether members extending from a first end to a second end;

a front breakaway connector comprising first and second front connector members, a first one of the first or second front connector members having an annular extension recessed radially inwardly from an exterior surface and having an outer diameter, and a second one of the first or second front connector members having an annular extension having an inner diameter sized to frictionally engage the outer diameter of the annular extension of the first one of the front connector members such that the first and second front connector members are detachably connectable together via a friction interference fit therebetween; and a rear breakaway connector comprising first and second rear connector members, a first one of the first or second rear connector members having an annular extension recessed radially inwardly from an exterior surface and having an outer diameter, and a second one of the first or second rear connector members having an annular extension having an inner diameter sized to frictionally engage the outer diameter of the annular extension of the first one of the rear connector members such that the first and second rear connector members are detachably connectable together via a friction interference fit therebetween;

wherein:

the mouthguard tether is fixed to the front breakaway connector, and the neck tether is fixed to the front breakaway connector and to the rear breakaway connector;

when a tensile force is exerted on the mouthguard tether, the first and second front connector members are configured to detach and the mouthguard tether is configured to separate from the front breakaway connector;

when a tensile force is exerted on the neck tether, the first and second rear connector members are configured to detach and the neck tether is configured to separate from the rear breakaway connector;

each of the first and second front connector members and each of the first and second rear connector members comprises an exterior surface and an interior surface, the interior surface defining a passage from an outer open end to an inner open end, the passage comprising a narrow passage section having a first diameter and a wide passage section having a second diameter greater than the first diameter, and an interior shelf extending radially between the narrow passage section and the wide passage section, the narrow passage section extending from the outer open end to the interior shelf, and the wide passage section extending from the interior shelf to the inner open end; and each of the first and second front connector members and each of the first and second rear connector members receives one of the first end or the second end of the mouthguard tether or one of the first end or the second end of the first or second neck tether members within the narrow passage section, and is secured thereto via a stopper knot located within the wide passage section.

2. The device of claim 1, wherein the first end and the second end of the mouthguard tether are fixed to the first front breakaway connector member, and the first ends of each of the first and second neck tether members are fixed to the second front connector member.

3. The device of claim 1, wherein the second end of the first neck tether member is fixed to the first rear connector member, and the second end of the second neck tether member is fixed to the second rear connector member.

4. The device of claim 1, wherein one or both of the front breakaway connector and the rear breakaway connector is configured to be reconnectable after detachment.

5. The device of claim 1, wherein each stopper knot abuts against a corresponding interior shelf of a corresponding mouthguard connector member when a tensile force is exerted on the mouthguard tether directed away from the first connector member of the front breakaway connector; and wherein each stopper knot abuts against the interior shelf of a corresponding neck tether connector member when a tensile force is exerted on the neck tether members directed away from the second connector member; and wherein, when a tensile force is exerted on the mouthguard tether or the neck tether members, the first and second front connector members detach before the mouthguard tether separates from the first front connector member, or the neck tether members separate from the second front connector member.

6. The device of claim 1, wherein an exterior surface of the front breakaway connector has a rounded cross section.

7. The device of claim 1, wherein an exterior surface of the rear breakaway connector has a rounded cross section.

8. The device of claim 1, wherein the mouthguard is configured to be placed within a user's mouth, and wherein the mouthguard tab is configured to extend externally from the user's mouth when the mouthguard is placed therein.

9. The device of claim 8, wherein the mouthguard tether is couplable to the mouthguard tab via a bight of the tether inserted through the aperture, and the first and second ends are passed through the bight and pulled taut.

10. The device of claim 1, wherein the mouthguard tether is a twisted or wound cord or woven webbing, and the neck tether members are twisted or wound cords or woven webbing.

11. The device of claim 1, wherein the neck tether of the lanyard assembly is configured to be worn around a neck of a user with the rear breakaway connector located at a back of the user's neck.

* * * * *